United States Patent [19]

Chung

[11] Patent Number: 4,915,925

[45] Date of Patent: Apr. 10, 1990

[54] EXFOLIATED GRAPHITE FIBERS AND ASSOCIATED METHOD

[76] Inventor: Deborah D. L. Chung, 3812 Henley Dr., Pittsburgh, Pa. 15235

[21] Appl. No.: 882,748

[22] Filed: Jul. 7, 1986

Related U.S. Application Data

[63] Continuation-in-part of Ser. No. 700,035, Feb. 11, 1985, abandoned.

[51] Int. Cl.[4] ..... C01B 31/04

[52] U.S. Cl. ..... 423/447.1; 252/378 R; 252/502; 252/511; 423/447.2; 423/448; 423/460; 428/367; 428/400; 428/408; 428/402

[58] Field of Search ..... 423/447.1, 447.2, 448, 423/460, 445; 252/378 R, 502, 511; 428/367, 400, 408, 902

[56] References Cited

U.S. PATENT DOCUMENTS

| | | | |
|---|---|---|---|
| 1,137,373 | 4/1915 | Aylsworth . | |
| 1,191,383 | 7/1916 | Aylsworth . | |
| 3,323,869 | 6/1967 | Olstowski | 423/448 |
| 3,404,061 | 10/1968 | Shane et al. | 423/460 |
| 3,476,703 | 11/1969 | Wadsworth et al. | 260/37 |
| 3,677,705 | 7/1972 | Ram et al. | 423/448 |
| 3,723,150 | 3/1973 | Druin et al. | 423/448 |
| 3,767,774 | 10/1973 | Hou | 423/447 |
| 4,005,183 | 1/1977 | Singer | 423/447.2 |
| 4,565,649 | 1/1986 | Vogel | 423/447.2 |
| 4,608,192 | 8/1986 | Su | 423/448 |

FOREIGN PATENT DOCUMENTS 1180441 2/1970 United Kingdom .

OTHER PUBLICATIONS

Anderson et al, "Thermodynamics of Intercalation of Bromine in Graphite", In *Intercalated Graphite,* Dresselhaus et al. eds. North-Holland, 1983, pp. 271-276.

Aoki et al, "Preparation and Thermal Expansion of Pyrolytic Graphite-Bromine Residual Compounds", J. Mater. Sci. 6:140-149 (1971).

Brocklehurst, "Thermal Expansion Measurements on Graphite-Bromine Compounds", Nature, 194:247-249 (1962).

Dowell, "Exfoliation Of Intercalated Graphites, Part I, Effect Of Graphite Crystallinity", 12th Biennial Conference On Carbon 31-33 (1975).

Dowell, "Exfoliation Of Graphite, Part II, Structure, Porosity, And The Mechanism of Exfoliation", 12th Biennial Conference On Carbon, pp. 35-36 (1975).

Hooley, "The Effect Of Flake Thickness On The Intercalation Of Graphite", Carbon, 10:155 (1972).

Hooley et al, "The Intercalation Of Bromine In Graphitized Carbon Fibers And Its Removal", Carbon, 16:251-257 (1978).

Martin et al, "The Thermal Expansion Behaviour Of Pyrolytic Graphite-Bromine Residue Compounds", Carbon, 1:133-141 (1964).

Miyauchi et al, "Anomalous Electric Resistivity Changes of Graphite-Bromine Residue Compound at High Temperature", Carbon, 9:807-808 (1971).

Olsen et al, "Expanded Pyrolytic Graphite: Structural And Transport Properties", Carbon, 8:85-93 (1970).

Stevens et al, "Exfoliated Graphite From The Intercalate With Ferric Chloride", Carbon, 11:525-530 (1973).

Chem. Abstracts 99:90047s.

Chem. Abstracts 99:160763y.

*Primary Examiner*—Robert L. Stoll

*Assistant Examiner*—Jeffrey Edwin Russel

[57] ABSTRACT

Graphite fibers are exfoliated to produce a fiber of reduced density, increased diameter, and flexibility with respect to graphite fibers prior to exfoliation. The fibers may also be used in composite articles. A method of producing exfoliated graphite fibers intercalates the fibers and then exfoliates the intercalated fiber by heating.

13 Claims, 5 Drawing Sheets

EXFOLIATED GRAPHITE FIBERS AND ASSOCIATED METHOD

CROSS REFERENCE TO RELATED APPLICATION

This application is a continuation-in-part of U.S. patent application Ser. No. 700,035 entitled "Exfoliated Graphite Fibers", filed Feb. 11, 1985, now abandoned.

BACKGROUND OF THE INVENTION

1. Field of the Invention.

This invention relates to graphite fibers, and more specifically, it relates to a class of improved graphite fibers called exfoliated graphite fibers, a method for making exfoliated graphite fibers and composites of exfoliated fibers.

2. Description of the Prior Art.

Graphite is a form of carbon consisting of layers of atoms. The bonding is relatively strong between atoms of the same layer, and is relatively weak between atoms of different layers. By exposing graphite to an appropriate chemical reagent, which is known as the intercalate, the intercalate goes into the graphite and occupies the spaces between the carbon layers. This process is known as intercalation. The resulting material, known as intercalated graphite or a graphite intercalation compound, consists of carbon layers and intercalate layers stacked on top of one another, ideally in a periodic fashion. For example, the stacking can be of the form C-C-I-C-C-I-C-C-I-C, where C stands for a carbon layer and I stands for an intercalate layer. The number of carbon layers between the nearest pair of intercalate layers is known as the stage, which is designated as 1, 2, 3, 4, etc. The herein above recited example is an example of stage 2.

Exfoliation refers to the instantaneous increase in the dimension generally perpendicular to the carbon layers. This process had been performed in graphite flakes (see U.S. Pat. Nos. 1,181,383 and 3,404,601) and pyrolytic graphite (see U.S. Pat. No. 3,404,061).

Processes for roughening the surface of graphite or carbon fibers by heating in various atmospheres have been known. See U.S. Pat. No. 3,476,703. In addition, composites of exfoliated flake graphite have been known. See U.S. Pat. No. 1,137,373.

In spite of the prior known materials and methods, there remains a need for graphite fiber material which possesses the desired properties of increased fiber diameter, reduced density, high flexibility, mechanical strength in the direction of the fiber axis, a high degree of parallel orientation, a high degree of electrical conductivity and thermal conductivity and improved adhesion properties when in composite form.

SUMMARY OF THE INVENTION

The graphite material, method and composites of the present invention have met the above-described need.

This invention relates to exfoliated graphite fibers of reduced density, increased flexibility, and increased fiber diameter with respect to graphite fibers prior to exfoliation. The fiber possesses high mechanical strength in the axial direction of the fiber axis as well as high electrical conductivity and thermal conductivity along the fiber axis.

Exfoliated graphite fibers can be employed advantageously in numerous uses, such as structural materials, electrical conductors and thermal conductors, and the like.

The method of producing exfoliated graphite fibers comprises intercalation of the fibers with an appropriate intercalating agent and then exfoliation of the intercalated graphite fiber by heating.

It is an object of the present invention to provide exfoliated graphite fibers of reduced density and increased diameter.

It is another object of the present invention to provide graphite fibers of good electrical conductivity and thermal conductivity.

It is an object of the present invention to provide a graphite fiber with good adhesion properties.

It is a further object of the present invention to provide a graphite fiber with an altered cross-sectional configuration.

It is another object of the present invention to provide a method of producing such exfoliated graphite fibers.

It is a further object of the present invention to provide composites containing exfoliated graphite fibers of the present invention.

These and other objects of the invention will be more fully understood from the following description of the invention with reference to the illustrations appended hereto.

BRIEF DESCRIPTION OF THE DRAWINGS

FIG. 1(*b*) is a cross-sectional schematic view of an exfoliated graphite fiber.

FIG. 3(*b*) is a magnified view of a scanning electron microscope photograph of an exfoliated graphite fiber of the present invention.

FIG. 4(*b*) is the back side of FIG. 3(*b*).

DESCRIPTION OF THE PREFERRED EMBODIMENTS

Graphite flakes and pyrolitic graphite have been successfully exfoliated. However, graphite fibers have never been successfully exfoliated. Exfoliated graphite fibers possess the properties of increased diameter and a lower density than other fibers. This is accomplished by the expansion which accompanies exfoliation. The fibers also possess a high degree of thermal and electrical conductivity generally along the fiber axis. Exfoliation of graphite fibers alters the cross sectional shape of the fibers. This change in the cross sectional shape of the fiber enhances the surface roughness resulting in improved adhesion between the fiber and an associated matrix in a composite material.

Surface roughening of graphite fibers was achieved in this invention by intercalation and subsequent exfoliation of the graphite fibers. Thus, the process of this invention is fundamentally different from the prior art which does not alter the cross-sectional shape of the graphite fibers.

The carbon layers in a graphite fiber are preferentially oriented with the layer planes containing the fiber longitudinal axis. Exfoliation of a graphite fiber results in substantial increase in the fiber diameter and thereby a decrease in the fiber density, while the portion of the fiber disposed along the fiber axis is less affected. In contrast, the carbon layers in flake or pyrolytic graphite are preferentially oriented in the plane of the flake or pyrolytic graphite slab, so that exfoliation of flake or pyrolytic graphite results in increase in this thickness while structure perpendicular to the thickness direction is much less affected. Therefore, due to the difference in texture or the preferred crystallographic orientation between fibers and flake or pyrolytic graphite, the geometrical effect of exfoliation is very different between fibers and flake or pyrolytic graphite. Because the mechanically strong direction of graphite is parallel to the carbon layers, the fiber axis remains strong after exfoliation.

Figure 1:
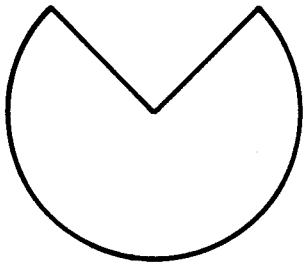
Prior art Fig. 1 (a)
FIG. 1(*a*) is a cross-sectional schematic view of an untreated graphite fiber.
Figure 1:
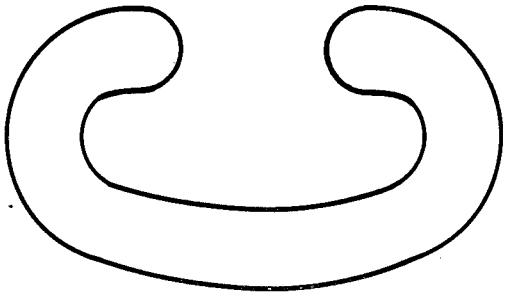

As a specific example, a product of Union Carbide, Thornel P-100-4 graphite fiber cross section is initially shaped like a notched groove or a V-shaped groove as shown in FIG. 1(*a*). The generally V-shaped groove extends adjacent to or to the center of the pristine fiber. This shape provides room for the expansion and the shear of graphite layers. After exfoliation, the cross-sectional shape or configuration is generally C-shaped as shown in FIG. 1(*b*). The cross-sectional shape increases the surface area per unit volume of the fiber, hence increasing the adhesion between the fiber and the matrix. Furthermore, it helps the fiber to lock on to the matrix, which tends to fill the void in the partially hollow fiber.

In addition, the ribbon morphology is a novel feature for fiber orientation control in the process of composite formation. Morphology concerns the shape, appearance, and surface of the fiber. Moreover, the ductility is a valuable feature which can simplify the process of composite formation. Ductility results in easier handling of the fibers.

In general, the method of the present invention for producing exfoliated graphite fibers involves two steps: (1) intercalation of the fibers with an appropriate intercalating agent, and (2) exfoliation of the intercalated graphite by heating. As intercalation must precede exfoliation, an exfoliated graphite fiber must have been intercalated.

Four factors are important in production of the exfoliated graphite fiber of the present invention: (a) using fibers that exhibit a strong texture or a high degree of orientation, (b) choosing a fiber that is highly graphitized, (c) high heating rate in the exfoliation step and (d) using a strong intercalate.

Thornel P-100 fibers, a graphite fiber sold by Union Carbide, are sufficiently graphitized for intercalation, however, they are not as strong in texture as Thornel P-100-4 fibers. In contrast, the Thornel P-100-4 fibers are sufficiently graphitized for intercalation and are sufficiently strong in texture for exfoliation, thus intercalated Thornel P-100-4 fibers may be exfoliated.

Intercalation is a process which affects the crystal structure of the graphite by the formation of a superlattice. A superlattice is a larger repetitive unit in the periodic crystal structure. Intercalation is most effective when there is a high degree of graphitization in the graphite host or a more perfect graphite structure. The degree of graphitization is higher in graphite flakes and pyrolytic graphite than in graphite fibers, therefore, graphite flakes and pyrolytic graphite can be intercalated much more easily than graphite fibers. Thus, for the intercalation of graphite fibers, it is desirable to choose a type of fiber which is highly graphitized. "Highly graphitized" means that the majority of the carbon is graphite. This standard is a qualitative. Graphitization can be determined by the presence of the 002, 100, 004, 110, 112 and 006 diffraction lines of graphite. In the choice of fibers, it should be noted that fibers produced from pitch are generally more graphitized than those produced from carbon textiles, such as polyacrylonitrile (PAN). For example, the Celion GY70 PAN-based fibers, a product of Celanese Corporation, and the Panex 30 PAN-based fibers, a product of Stackpole Corporation, are not sufficiently graphitized for intercalation, as revealed by x-ray diffraction. The Thornel P-100-4 fibers, mentioned supra, are pitch-based and provide a specific example of a sufficiently graphitized fiber. Another example of a sufficiently graphitized fiber is the Thornel P-100 fiber, a product of Union Carbide.

A good intercalating agent has a high tendency to donate or accept electrons to or from graphite. Furthermore, it has a high affinity for the basal plane of graphite. The basal plane of graphite is the surface of the graphite layers.

The tendency for intercalation of graphite increases with increasing tendency of the intercalate to undergo electron transfer with graphite. Because of the relative difficulty of intercalating graphite fibers, it is desirable to use a strong intercalate with a high vapor pressure. An intercalate with a high vapor pressure is an intercalate with a melting point generally lower than room temperature. Examples of an intercalate with a high tendency to intercalate pristine graphite fibers are iodine monochloride (ICl), cesium (Cs), bromine ($Br_2$), and nitric acid ($HNO_3$). The intercalate may be in liquid or vapor form. However, the liquid form is preferred. The pristine graphite fibers are preferably immersed in the intercalate at least about the boiling point of the intercalate. For example, graphite fibers can be intercalated by immersion in liquid ICl at 100° C. for about 12 hours or more.

Exfoliation is generally accompanied by some desorption of the intercalate from the intercalated graphite. To obtain a larger amount of expansion, it is desirable to exfoliate by the use of a high heating rate, so that desorption does not have time to occur significantly before exfoliation occurs. The time needed for significant desorption decreases with decreasing sample size because desorption involves the diffusion of the intercalate outward from the graphite. As a result, the time needed for significant desorption is short for small samples such as fibers. For example, only a few minutes are needed to desorb about 75 percent of the intercalate. Therefore, a high heating temperature of at least about 850° C. to 1100° C., and preferably a temperature of at least about 1000° C., is necessary for the exfoliation of the fibers. The fibers are preferably heated for a very short time, such as for a fraction of a second, for example, 0.1 second. Various methods of obtaining a high heating rate may be used. One example is the passage of a sufficiently large electric current pulse through the fibers. For example, 0.5 seconds at 24 V and 0.6 A, DC, for a single fiber of length about 1 cm. Alternatively, the fibers may be contacted with a hot surface. To resist undesired oxidation of the fibers during heating, heating may be done in a substantial vacuum, below about 250 μ of Hg., preferably a vacuum of about 200 μ of Hg.

Exfoliation produces a texture in which the carbon layers are preferentially oriented generally parallel to each other, because exfoliation is an anisotropic process involving expansion in the direction perpendicular to the carbon layers. Due to this geometrical consideration, the potential for exfoliation is increased with a higher degree of preferred orientation or a strong texture. Texture strength is the degree of preferred orientation. Flake graphite and pyrolytic graphite have a much stronger texture than graphite fibers, and may be exfoliated much more easily than graphite fibers. Thus, for the exfoliation of graphite fibers, it is preferred to choose a type of fiber which exhibits a strong texture. An example of the type of fibers which exhibit such texture is a fiber in which the carbon layers contain the fiber axis and are directed generally radially perpendicular to the fiber axis, such that each fiber initially has a generally V-shaped groove reaching to about the center of the circular cross-section of the fiber and extending along the length of the fiber. The V-shaped groove extends adjacent to or to the center of the pristine graphite fiber. This configuration is illustrated in FIG. 1(*a*). The cross-sectional shape of the exfoliated fiber is generally C-shaped, as illustrated in FIG. 1(*b*). The Thornel P-100-4 fibers made by Union Carbide Corporation provide a specific example. The radial microstructure of an untreated Thornel P-100-4 graphite fiber is revealed in FIG. 2.

Texture strength is defined as the degree of preferred orientation. Graphite layers are generally parallel. The greater the alignment, the stronger the texture. Flake graphite is natural graphite in flake form. Another form of graphite is synthetic pyrolitic graphite.

A further advantage of exfoliated graphite fibers over the untreated graphite fibers is the improved adhesion between the fibers and the matrix caused by the roughness and relatively large area of the surface of exfoliated graphite fibers. In the case of Thornel P-100-4 fibers, the generally C-shaped cross-sectional configuration helps the fiber lock on to the polymer matrix, thereby further enhancing the securement between the fibers and the matrix.

The exfoliated graphite fibers of the invention may be used, for example, in a composite with a polymer, a metal, carbon, or other materials, as the matrix. In the composite, the exfoliated graphite fibers may serve to reinforce; to lower the density of the composite; and to increase the electrical conductivity or thermal conductivity of the composite.

Specific materials such as polyimide, polyester, pitch, carbon from baking pitch, carbon from baking polyimide, copper, and the like may be used as a composite matrix. The composite containing the composite material and the exfoliated fibers are formed by standard means such as lamination or fiber winding, for example. Alternatively, when forming the composite by lamination, the heating step for exfoliation may be combined with the lamination step, if desired.

Applications of the composites include, for example, use as a structural material, an electrical conductor, an electromagnetic interference shield, a thermal conductor, and the like. Of importance in some or all of the applications is the anisotropy of the composites due to the anisotropy in mechanical, electrical and thermal properties of each fiber.

EXAMPLE

Figure 3:
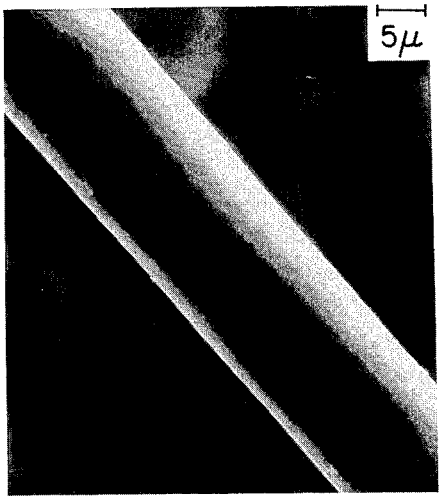
Prior art Fig. 3 (a)
FIG. 3(*a*) is a magnified view of a scanning electron microscope photograph of an untreated graphite fiber.
Figure 3:
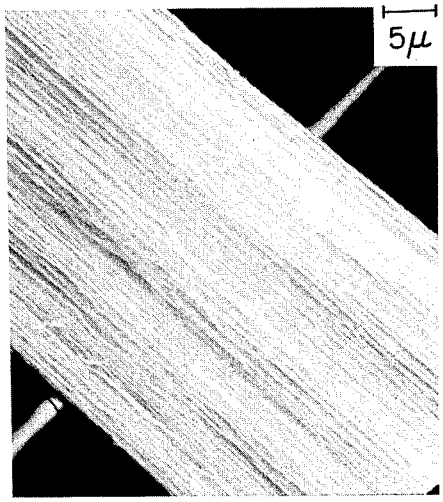
Figure 4:
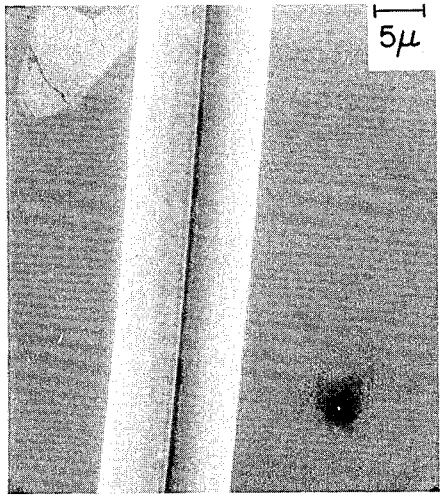
Prior art Fig. 4 (a)
FIG. 4(*a*) is the back side of FIG. 3(*a*).
Figure 4:
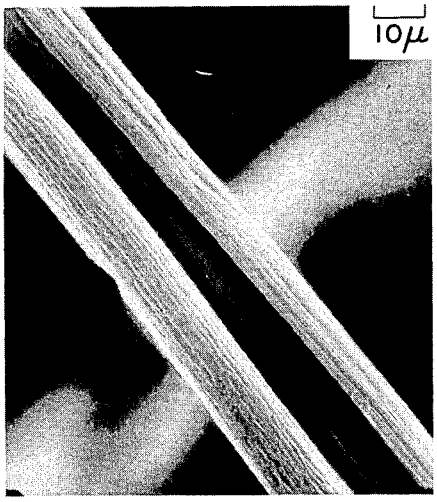

FIG. 3 shows the Thornel P-100-4 fibers (a) before and (b) after exfoliation. FIG. 4(*a*) shows the back sides of FIGS. 3(*a*) and (*b*), respectively. The exfoliation of this particular example material was carried out by (1) intercalating ICl in the fibers by immersion of the fibers in liquid ICl at 100° C. for about 10 hours. The fibers may remain immersed for longer periods without damage to the fiber, and (2) exfoliating the intercalated fibers by the passage of an electric current pulse through the fibers at about 1000° C. for 0.1 second. The exfoliated fiber shown in FIG. 1(*b*) has a diameter which is more than double of that before exfoliation (FIG. 1(*a*)). The surface of the exfoliated fiber, as shown in FIG. 1(*b*), is wrinkled in a microscopic scale, with the ridges generally along the fiber axis. Pristine graphite fibers are placed in thin tubing (a) sealed without evacuation. The tube is immersed in an oil bath at about 100° C.

Figure 2:
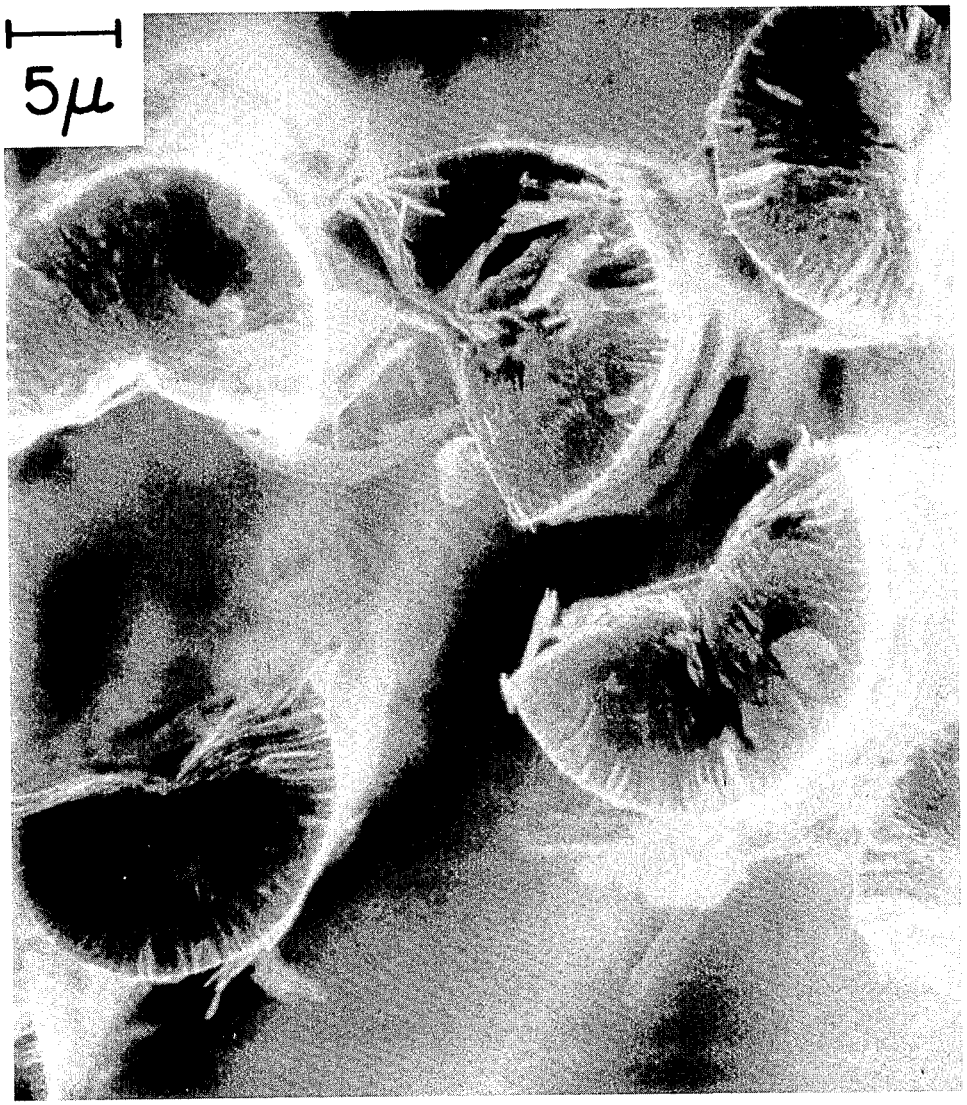
Prior art Fig. 2
FIG. 2 is a cross-sectional magnified view of a scanning electron microscope photograph of untreated graphite fibers sold under the trade designation of Thornel P-100-4, a product of Union Carbide.

Prior to intercalation and exfoliation, the untreated Thornel P-100-4 graphite fiber has a generally V-shaped groove reaching to about the center of the circular cross-section of the fiber and extending along the full length of the fiber (See FIG. 4(*a*)). After intercalation, this shape is maintained. However, after exfoliation the fiber becomes generally C-shaped in cross-section as shown in FIG. 1(*b*). A generally C-shaped graphite fiber may be viewed as a graphite fiber in the form of a ribbon which is curved along the "width" of the ribbon. The term "width" refers to the dimension perpendicular to the fiber longitudinal axis. Such a graphite fiber may also be viewed as a generally partially hollow graphite fiber. FIG. 2 shows the cross-sectional microscopic view of untreated Thornel P-100-4 fibers. A C-shaped graphite fiber which is obtained by the invention is shown in FIG. 3(*b*). For the sake of comparison, FIG. 3(*a*) shows such a fiber before exfoliation, but after intercalation.

Figure 5:
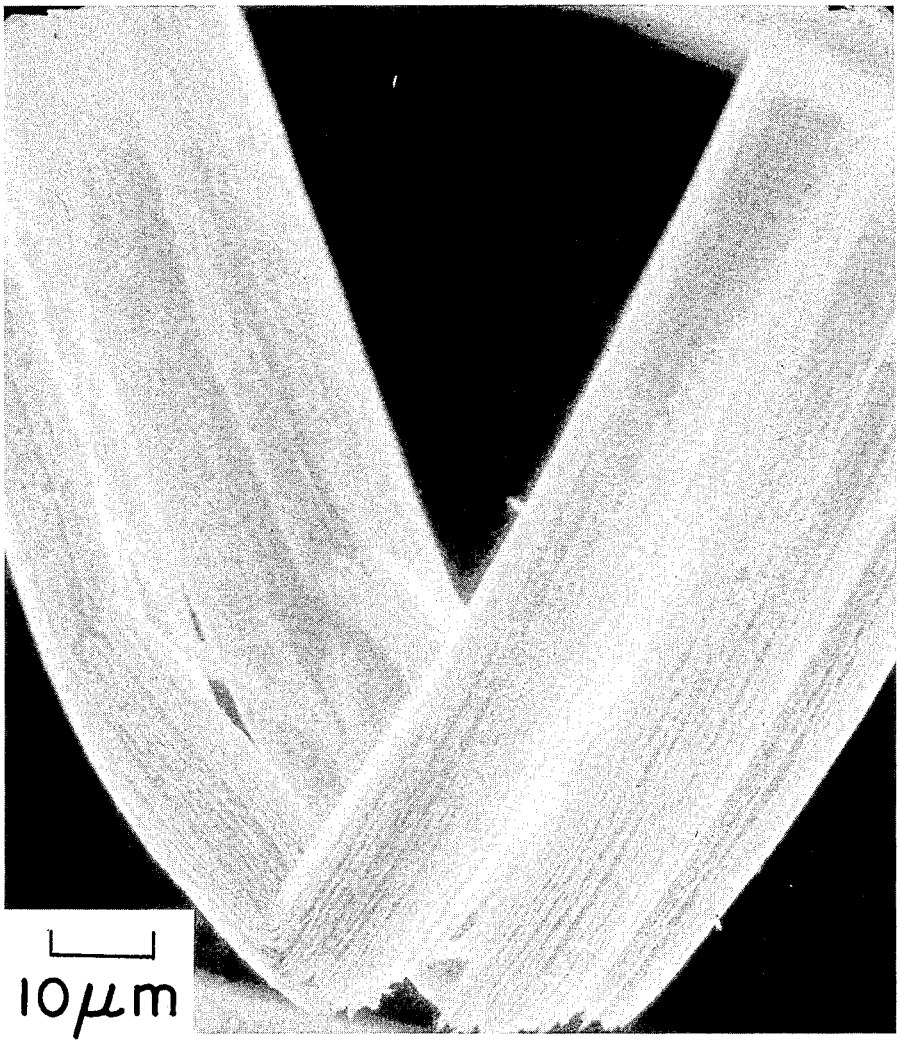
FIG. 5 is a magnified view of a scanning electron microscope photograph of a crimped exfoliated fiber.

If desired, a generally C-shaped graphite fiber can be compressed or flattened into a relatively flat graphite ribbon. A partially flattened graphite ribbon produced by crimping a curved graphite ribbon by any appropriate means, such as human fingers is shown in FIG. 5. The flattened ribbon morphology provides a fiber which is aniosotropic in three mutually perpendicular directions, in contrast to the radial symmetry of fibers with circular cross-sections. FIG. 5 also shows that the crimped ribbon remains continuous in spite of the very small radius of curvature at the crimp. In contrast, untreated graphite fibers are known to be so brittle that they cannot be bent significantly before fracture. The exfoliated graphite fibers are therefore less brittle than untreated graphite fibers.

It will be appreciated, therefore, that the present invention provides a graphite fiber material which is of a low density, has a high degree of parallel orientation, possesses good thermal and electrical conductivity, has increased diameter and improved adhesion properties. The method of producing exfoliated graphite fibers involves intercalation of the fibers with an appropriate intercalate, and exfoliation of the intercalated graphite fiber by heating. Exfoliated graphite fibers of the present invention may be used with composite matrix materials.

Whereas particular embodiments of the invention have been described above for purposes of illustration, it will be appreciated by those skilled in the art that numerous variations of the details may be made without departing from the invention as described in the appended claims.

I claim:

1. A method of producing an exfoliated graphite fiber comprising intercalating a graphite fiber with an intercalating agent to form an intercalated fiber, and heating said intercalated fiber to exfoliate said intercalated fiber.

2. The method of claim 1 wherein the cross-sectional configuration of said exfoliated graphite fiber is altered during exfoliation.

3. The method of claim 1 including effecting said intercalating on a pristine graphite fiber.

4. The method of claim 3 including employing said pristine graphite fibers with a V-shaped groove therein and extending along the fiber axis of said pristine graphite fiber.

5. The method of claim 3 including said pristine graphite with a V-shaped groove extending adjacent to or to the center of said fiber.

6. The method of claim 4 including converting said pristine graphite fiber to a partially hollow ribbon fiber during exfoliation.

7. The method of claim 1 including employing an intercalating agent having a high vapor pressure such that the melting point of the intercalating agent is not substantially greater than room temperature, said intercalating agent being an electron donor or acceptor to graphite and said intercalating agent having an affinity for the basal plane of graphite.

8. The method of claim 7 including employing an intercalating agent selected from the group consisting of iodine monochloride, cesium, bromine, and nitric acid.

9. The method of claim 3 wherein said intercalated fiber is exfoliated at a temperature of from about 850° C. to 1100° C.

10. The method of claim 3 wherein said temperature is at least about 1000° C.

11. The method of claim 1 including heating said intercalated fiber for at least about 0.1 second.

12. The method of claim 6 including establishing a C-shaped cross-sectional configuration in said partially hollow ribbon.

13. The method of claim 1 including heating in a substantial vacuum.

* * * * *